United States Patent [19]

Radwanski et al.

[11] Patent Number: 4,961,415

[45] Date of Patent: Oct. 9, 1990

[54] CONTROLLED DRAFT AND EFFICIENCY FILTER ELEMENT FOR SMOKING ARTICLES

[75] Inventors: Fred R. Radwanski, Norcross; Donald F. Durocher, Roswell; Leon E. Chambers, Jr., Roswell; Loyd G. Kasbo, Norcross; William F. Cartwright, Roswell; Robert G. Geer, Woodstock; Edward P. Bullwinkel, Roswell, all of Ga.

[73] Assignee: Kimberly-Clark Corporation, Neenah, Wis.

[21] Appl. No.: 3,980

[22] Filed: Jan. 16, 1987

[51] Int. Cl.[5] ..... A24D 3/06; A24D 3/04

[52] U.S. Cl. ..... 131/332; 131/361; 264/518; 264/DIG. 25

[58] Field of Search ..... 131/362, 331; 264/518, 264/DIG. 25

[56] References Cited

U.S. PATENT DOCUMENTS

| | | | |
|---|---|---|---|
| 439,004 | 10/1890 | Harris . | |
| 2,966,157 | 12/1960 | Touey et al. . | |
| 3,110,642 | 11/1963 | Harrington . | |
| 3,226,795 | 1/1966 | Swerdloff . | |
| 3,329,544 | 7/1967 | Smith et al. . | |
| 3,393,685 | 7/1968 | Mumpower, II . | |
| 3,396,733 | 8/1968 | Allseits et al. . | |
| 3,407,822 | 10/1968 | Touey et al. . | |
| 3,461,882 | 8/1969 | Epstein . | |
| 3,509,009 | 4/1970 | Hartmann . | |
| 3,538,920 | 11/1970 | Davis . | |
| 3,595,245 | 7/1971 | Buntin . | |
| 3,608,564 | 9/1971 | Takahashi . | |
| 3,749,685 | 7/1973 | Johnson, Jr. . | |
| 3,856,025 | 12/1974 | Sato . | |
| 3,861,404 | 1/1975 | Changani . | |
| 3,880,173 | 4/1975 | Hill . | |
| 3,882,877 | 5/1975 | Brackmann . | |
| 3,887,730 | 6/1975 | Rainer . | |
| 3,930,077 | 12/1975 | Levers et al. . | |
| 3,939,849 | 2/1976 | Baxter . | |
| 3,978,185 | 8/1976 | Buntin . | |
| 4,054,550 | 10/1977 | Parker . | |
| 4,059,121 | 11/1977 | Brackmann . | |
| 4,182,350 | 1/1980 | Steinau . | |
| 4,232,130 | 11/1980 | Baxter . | |
| 4,279,848 | 7/1981 | Baxter et al. . | |
| 4,364,403 | 12/1982 | Horsewell et al. | 131/362 |
| 4,366,826 | 1/1983 | Horsewell | 131/362 |
| 4,379,465 | 4/1983 | Coq . | |
| 4,546,040 | 10/1985 | Knotek . | |

*Primary Examiner*—V. Millin

*Attorney, Agent, or Firm*—William D. Herrick

[57] ABSTRACT

Nonwoven web comprising thermoplastic meltblown fibers or filaments predominantly present as agglomerates or multiple fused fiber areas. Such agglomerates in the web act as columns and impart a desired degree of strength and resistance to compaction. In contrast to prior art webs where such agglomerates have been considered undesirable, the webs of the present invention find particular utility when formed into cylinders as filter plugs for smoking articles. In smoking articles of the invention, the filter plugs have a desired pressure drop while demonstrating an unexpected degree of firmness, all at an economically attractive cost. Preferred embodiments include those where the machine direction strength to cross machine direction grab tensile ratios in the range of from about 1:1 to 4:1 and the fibers or filaments are made from polypropylene. Other embodiments include webs and filter plugs containing additives distributed throughout the web.

17 Claims, 5 Drawing Sheets

FIG. # 3
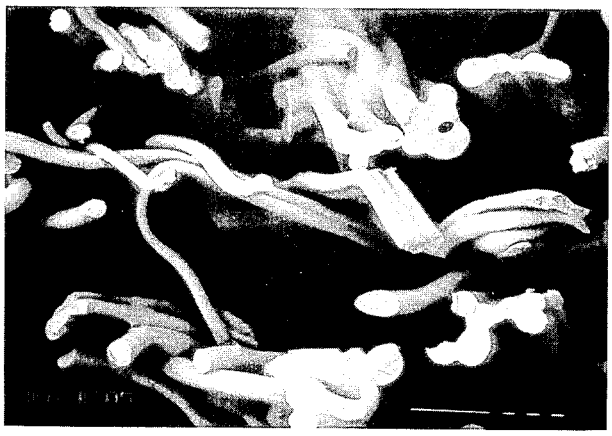
FIG. # 4
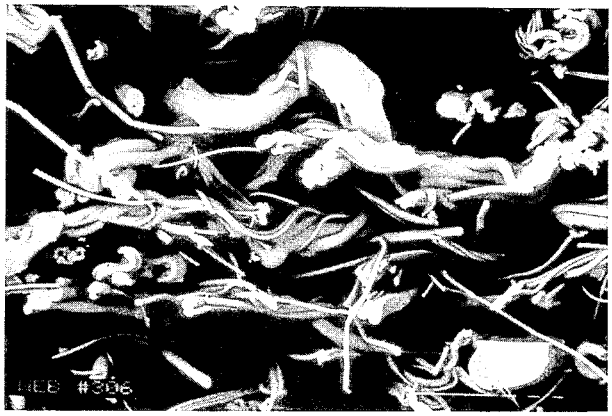
FIG. # 5
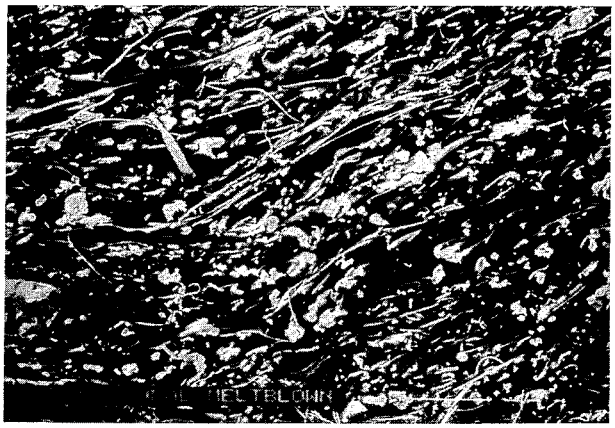

FIG. #6
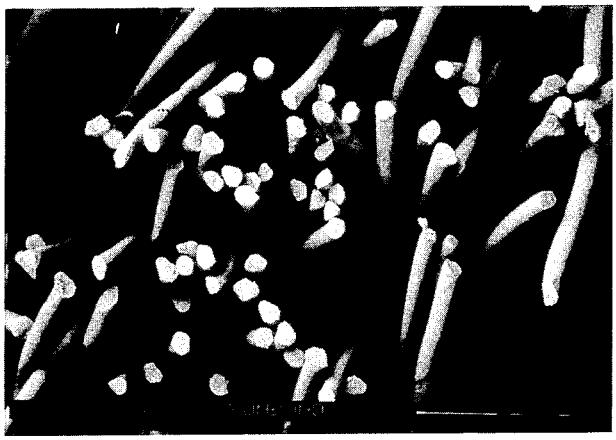
FIG # 7
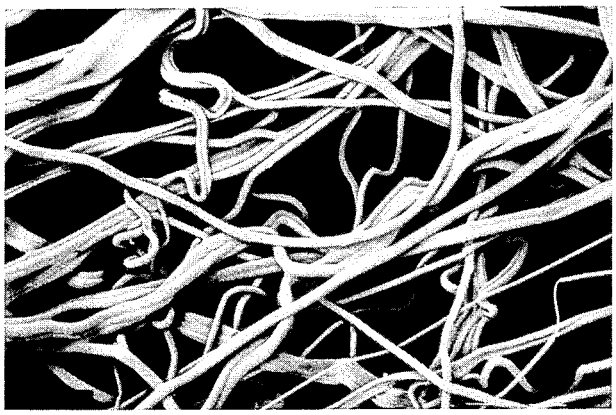
FIG. #8
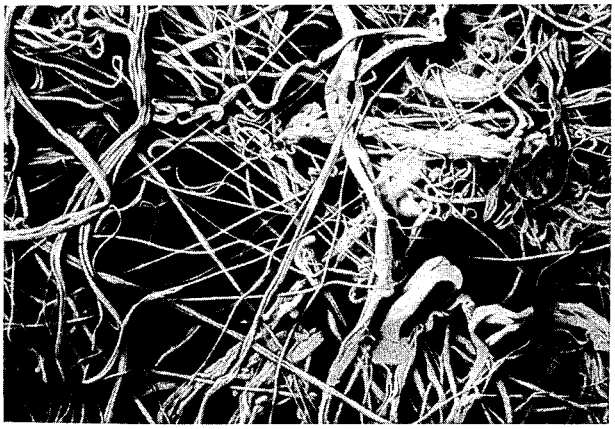

FIG. # 9
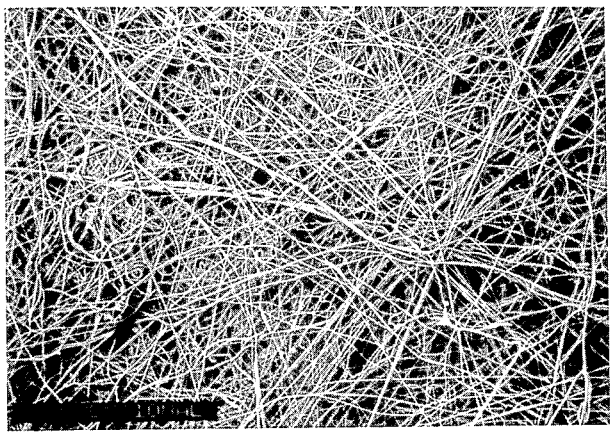
FIG. # 10
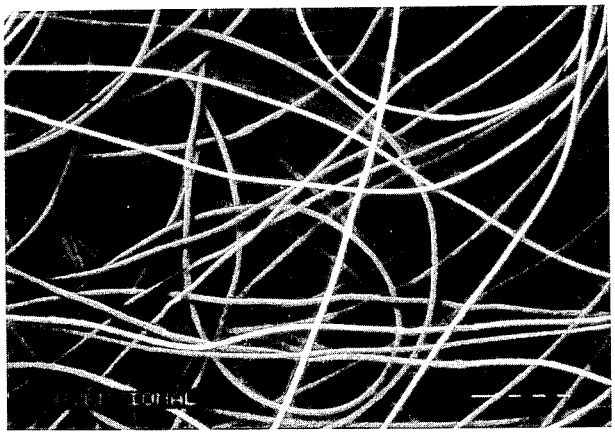

CONTROLLED DRAFT AND EFFICIENCY FILTER ELEMENT FOR SMOKING ARTICLES

BACKGROUND OF THE INVENTION

1. Field of the Invention

This invention is directed to improvements in filter elements for smoking articles. While the invention will be described with reference to a preferred embodiment as a cigarette filter, it will be recognized by those skilled in the art that the field is broader and includes other applications such as filters for small cigars. Moreover, recent innovations have expanded the use of smoking devices into areas such as delivery of medicaments. Examples of these applications include Gabriel U.S. Pat. No. 4,598,720 dated 8 July 1986 and European Published Application No. 0174645 to R. J. Reynolds Tobacco Company published 19 March 1986. The filter element of the invention, thus, is broadly useful for smoking articles of widely varying types and constructions which will be more apparent in light of the description which follows.

2. Description of the Prior Art

Filtered cigarettes are well known and the most common form of smoking articles. They comprise a column of tobacco and, at one end, a filter plug with the combination wrapped in a thin paper. Conventional filter plugs are formed either from compressed strips of paper or cellulose acetate. It has long been recognized that certain thermoplastic polymers possess attributes that would suggest their use as cigarette filter plug materials. For example, Buntin et al. U.S. Pat. No. 3,595,245 dated 26 July 1971 is directed to a meltblown roving of polypropylene fibers formed as a tow and processed into cigarette filter plugs. Further discussion of such polypropylene fiber cigarette filters may be found in U.S. Pat. No. 4,546,040 dated 8 Oct. 1985 to Knotek et al. and in the references cited therein at column 1, lines 44–57. In spite of such teachings, thermoplastic polymer fiber filter plugs, notably those made of polypropylene fibers, have achieved little, if any, commercial success. Common deficiencies of prior attempts to form thermoplastic fiber filter plugs have included inadequate firmness so that the filter end of the cigarette has an uncharacteristic and undesirable softness and a greater than desired pressure drop so that the smoker experiences a perceivable increase in draw resistance. It is desired, therefore, to provide filter plugs for smoking articles that take advantage of the economies of thermoplastic fiber formation and yet have improved properties overcoming these deficiencies as well as possessing other advantages.

SUMMARY OF THE INVENTION

The present invention provides a filter plug for smoking articles that is made from thermoplastic fibers and has controlled pressure drop and filter efficiency while providing a desired degree of filter firmness. These results are obtained while maintaining the economies of thermoplastic fiber formation and without significant adverse effect on taste or other desirable smoking properties. In accordance with the invention, the filter plug is made from a preformed thermoplastic fiber web rather than as a tow or roving as predominantly suggested in the prior art relating to thermoplastic fiber cigarette filters. The thermoplastic fiber web starting material has defined properties including machine direction to cross machine direction fiber directionality, basis weight, porosity, fiber width distribution, percent open area, tear strength and bending modulus. This filter web may be formed into filter plugs using conventional filter plug making equipment where a selected width of the web is substituted for the conventional cellulose acetate tow feed. In accordance with preferred embodiments of the invention, the thermoplastic polymer is polypropylene, and the web is formed by meltblowing.

BRIEF DESCRIPTION OF THE DRAWINGS

FIGS. 3–10 are scanning electron micrographs of certain filter plug cross-sections and plan views of different webs.

DESCRIPTION OF THE PREFERRED EMBODIMENTS

Figure 1:
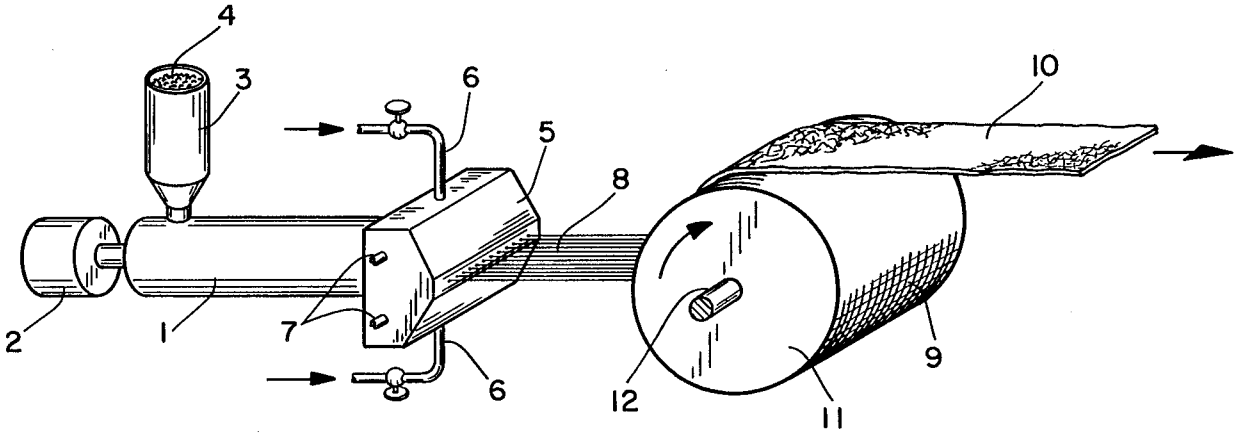
FIG. 1 (PRIOR ART)
FIG. 1 illustrates one preferred method for forming webs useful in accordance with the present invention.

While the invention will be described in connection with preferred embodiments, it will be understood that it is not intended to limit the invention to those embodiments. On the contrary, it is intended to cover all alternatives, modifications and equivalents as may be included within the spirit and scope of the invention as defined by the appended claims.

For purposes of the present description, the test results reported below were obtained in accordance with the test procedures described hereinafter.

Grab tensile strength was determined generally in accordance with the Method 5100-Federal Test Methods Standard No. 191A using an Instron Model 1122 Testing Instrument available from Instron Corporation. These strengths depend on the web's machine direction (MD) to cross machine direction (CD) fiber orientation, degree of fiber to fiber fusion and fiber width distribution. The webs useful in accordance with the invention will have grab tensile strengths within the range of from about 0.1 pound to 3.0 pounds in the cross machine direction and at least about 0.1 pound in the machine direction. Preferred ranges are from 0.7 to 2.4 pounds in the machine direction and in the about 0.5 to 2.3 pounds from cross machine direction. In accordance with the present invention, useful webs will have grab tensile strengths providing a ratio of MD to CD strengths in the range of about 1:1 to 4:1 and preferably in the range of 1:1 to 2:1.

Trapezoidal tear test results were obtained generally in accordance with ASTM D 1117-14 except that the tearing load was calculated as the average of the first and highest peaks recorded rather than the lowest and highest. In general, a sample is cut out using a trapezoidal-shaped template with a 3.0 inch altitude and 1.0 and 4.0 inch long bases. Next, the sample was slit $\frac{3}{8}$ of an inch deep normal to and at the midpoint of the shorter base (as a result, the tear propagated across the remaining width of the sample–$2\frac{3}{8}$ inches). Thereafter, the sample was inserted in the tensile tester so that the sides of the trapezoid were parallel with the clamps. In accordance with the invention, webs will have average tearing loads (as defined above) in the range of from about 0.1 pound to 3.0 pounds in the cross machine direction and at least 0.1 pound in the machine direction. Preferably, the results will be in the range of from about 0.3 pound to 1.4 pounds in the machine direction and 0.3 pound to 1.3 pounds in the cross machine direction.

Frazier porosity tests were run using a Frazier air permeability tester available from Frazier Precision Instrument Company. These porosity measurements reflect the air permeability of the web. The procedure conforms to Method 5450, Federal Test Methods Standard No. 191A except that the specimen size used was 8 inches by 8 inches, and a 5-ply sample was measured with a 20 mm air nozzle. Frazier units are expressed in cubic feet of air per square foot of specimen per minute. In accordance with the invention, webs will have a Frazier porosity in the range generally from 100 cu.ft./sq.ft./min. to 1000 cu.ft./sq.ft./min. and, preferably in the range of from 150 cu.ft./sq.ft./min. to about 1000 cu.ft./sq.ft./min. (for a 5-ply sample).

Handle-O-Meter stiffness tests were determined by using a Model 211-5 Handle-O-Meter from Thwing Albert Instrument Company. These test results are indicative of a meltblown web's bending modulus which assists in determining a web's processability into a filter plug and the firmness of the resultant plug. In general, a 4×4 inch web sample was placed over a ¼ inch wide slot. The force in grams necessary to push the sample through the slot was then measured. Both the machine and cross machine directions were tested. The webs useful in accordance with the invention will preferably have Handle-0-Meter results not exceeding 40 grams measured in both the cross machine direction and in the machine direction.

In general, webs of the present invention particularly suitable for filter plug applications will have a basis weight in the range of from about 0.5 oz/yd$^2$ to 1.0 oz/yd$^2$.

The percent open area is a measure of the web's openness and was measured using a Quantimet Model 970 image analyzer available from Cambridge Instruments. This property is significant in determining the filtration characteristics of filter plugs made from webs in accordance with the present invention. In general, the web percent open area in accordance with the invention will be from about 10 percent to 60 percent with the preferred range generally from about 14 percent to 52 percent.

Fiber and fiber agglomerates' cross-sectional dimensions were measured using SEM photographs of sectioned webs. In order to provide large numbers of fiber cross-sections per photograph, the webs were first formed into filter plugs and then sectioned transversely with a sharp razor. To prevent "smearing" of the cut fiber ends, the sectioning was performed on the plugs while they were submerged in a liquid nitrogen bath.

For purposes of this invention agglomerates are defined as fused or partially fused bundles of fibers or filaments, and webs useful in accordance with the invention will have a predominance of agglomerates; that is, more than half the fibers or filaments will be present as agglomerates. SEM photographs were also taken normal to the web in order to determine the unsupported length of the fiber agglomerates (i.e., the average distance between points where these agglomerates are fused or welded to each other in the plane of the web). A light microscopy procedure was used to determine these lengths which involved first measuring the distances between crossings and then testing for the presence of welds at the crossing by manually teasing the relevant agglomerates with a fine dissecting needle. In general, it was found with the webs of the present invention that the majority of crossings of the fiber agglomerates represent weld points. For conventional meltblown webs, this was not found to be true.

Additional tests were carried out on filter plugs made using conventional plug making equipment. These tests comprised filter weight, firmness and collapse, pressure drop, and filter efficiency. Each test is described below.

Filter weight is the mass of web incorporated into an individual filter plug and is reported in units of mg of web per 1 cm of filter plug length. In general, while not critical to the invention, the filter weights will preferably be in the range of 55 to 95 mg per cm of filter plug length.

Figure 11:
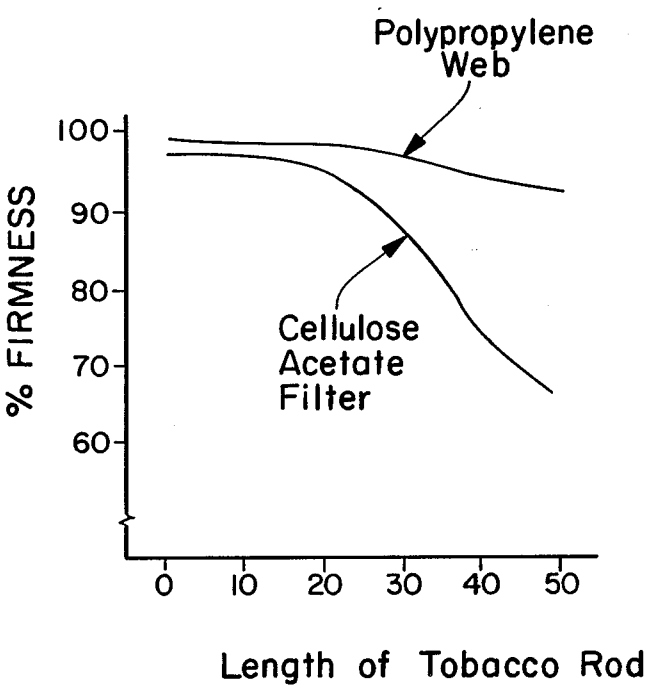
FIG. 11 is a graph illustrating filter plug collapse during cigarette smoking.

Filter firmness results were obtained by placing a filter plug under a 19 mm diameter platen. The platen was brought into contact with the filter and an initial uncompressed diameter reading taken. In this condition an actual force of some 27 grams was exerted on the filter. The platen was then loaded with an additional 100 grams of weight. After about 10 seconds under this loading, a second reading was taken. The firmness was reported as a percentage and was calculated by multiplying the ratio of the second reading to the first reading by 100. In general, the range of filter firmnesses will be from about 94 percent to about 99 percent with a preferred range of from about 96 percent to about 98 percent. This test was also performed on filter plugs attached to a tobacco rod (i.e., a normal filter cigarette construction). These cigarettes were then smoked using a continuous draw on the lit cigarette of 185 cc per minute to determine filter collapse as shown in FIG. 11.

In general, filter pressure drop is the pressure drop in centimeters of water when 1050 cm$^3$/min. of air is passed through a filter plug. These pressure drops may be normalized to unit length of filter plug by dividing by the actual filter length. In accordance with the invention, the pressure drop will be generally in the range of about 0.1 to 6.0 cm water/cm filter length with preferred pressure drop in the range of from about 0.5 to about 4.5 cm water/cm filter length.

Total particulate matter (TPM) produced from smoking a cigarette with a filter (21 mm long) was determined using the FTC (Federal Trade Commission) method. A tobacco rod (70 mm × 8.0 mm diameter) was attached to the filter plug and inserted into a smoking machine (RM 4/CS Model) available from Heinr. Borgwaldt. Smoking was done by taking 35 cc puffs of two-second duration once a minute. The total particulate matter (TPM) was determined by weighing the Cambridge filter pad before and after smoking.

Filter efficiency was determined by measuring total particulate matter (TPM), as described above. To calculate the efficiency, the results from smoking a cigarette rod with an installed filter plug were divided by the results from smoking a filterless control tobacco rod and multiplying by 100 to express the efficiency as a percentage.

Moisture delivery in TPM was also determined by extracting the Cambridge filter pad with isopropyl alcohol (methanol as internal reference) followed by gas chromatography (GC). Nicotine delivery was determined by extraction of the Cambridge filter pads with methanol-hydrochloric acid followed by uv spectrophotometry.

The delivery results (TPM, nicotine, moisture) are given in Table VI, both on a per cigarette and on a per puff basis. As is apparent from Table VI, the performance of the filter made from webs in accordance with the invention is very similar to that of conventional cellulose acetate (CA) filters, providing nicotine deliveries on the order of 5 percent and moisture deliveries of 15–20 percent based on TPM.

While most thermoplastic polymers may be used in accordance with the invention, preferred are those in the polyolefin group, such as isotactic polypropylene, and polyesters such as poly (butylene terephthalate). Due to the nature of the meltblown thermoforming process, additives (e.g., calcium carbonate) can be easily incorporated internally in the polymer melt or blown onto the molten polymer surface as it is extruded in order to change the structure of the meltblown web and thus its performance in a filter element. Also, meltblown webs, after formation, are easily subject to known post treatments with auxiliary agents in dry or liquid form to provide certain organoleptic and/or medicinal attributes.

The preferred means for forming a web useful in accordance with the invention is by meltblowing such as is described in Buntin et al. U.S. Pat. No. 3,849,241 dated 19 Nov. 1974, which is incorporated herein by reference.

Referring to FIG. 1, however, conventional meltblowing will be described. Extruder 1 driven by motor 2 receives pellets 4 from hopper 3. The extruder is heated as necessary to bring the polymer to the desired viscosity entering die 5. As the extruded polymer exits die 5 it is contacted from opposing sides by hot air from conduits 6. As needed, die 5 may be heated electrically or by other means using conduits 7. Fibers 8 are carried by the air stream onto collecting surface 9 forming mat 10. The collecting surface 9 may comprise rotating drum 11 driven about axis 12 as shown or may be a belt, screen or other collecting device as will be apparent to those skilled in this art.

Figure 2:
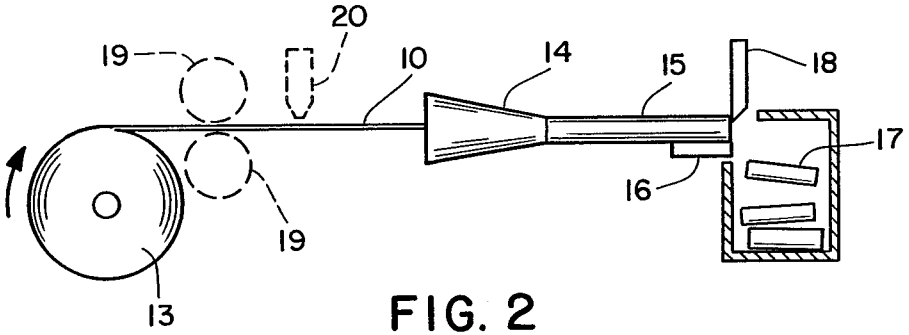
FIG. 2 schematically illustrates a method of forming a web into a filter rod.

FIG. 2 illustrates the preferred means for forming the webs into a filter plug. In general, this means differs little from ordinary plugmakers used with cellulose acetate tows.

As shown schematically in FIG. 2, a roll 13 of thermoplastic fiber web 10 is unwound and drawn into a pre-forming apparatus 14 that "gathers" or "folds" the flat web 10 into a cylindrical shape 15 suitable for passage into the filter plugmaker. This formed cylinder 15 receives a wrapping of paper web 16 (so called plug wrap) and the combination is cut into desired lengths 17 using blade 18. The cut plugs are usually carried into a garniture via an endless forming belt (not shown). Prior to entering the garniture, a continuous bead of adhesive is applied to one edge of the plugwrap via an applicator; as these components pass through the garniture, the formed web is compressed into a cylindrical cross-sectional rod while at the same time being enveloped by the plugwrap 16. As the adhesive bead contacts the overlapped section of wrapped rod, it is sealed by means of a sealing bar. This endless filter rod is then cut into lengths 17 by means of cutter 18.

Figure 13:
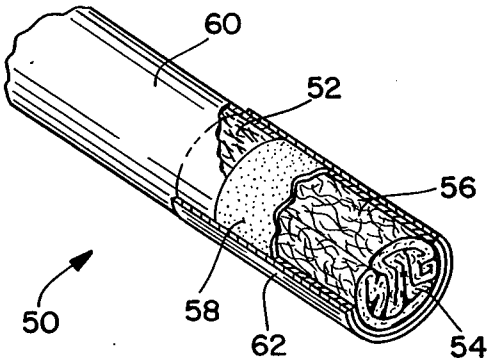
FIG. 13 is a partial perspective view of a smoking article in accordance with the present invention.

Referring to FIG. 13, a smoking article 50 is partially shown in the form of a cigarette comprising tobacco rod 52 enclosed by cigarette wrapper 60 and joined to filter plug 54 comprising web 56 and plug wrap 58 by means of tipping paper strip 62.

While not essential for making acceptable filter plugs, the webs made in accordance with the present invention lend themselves to pre-treatment prior to being formed into a filter rod. Two such treatments, illustrated in FIG. 2, are a pair of grooved rolls 19 used for crimping and a liquid applicator 20 used for surface treating.

Figure 12:
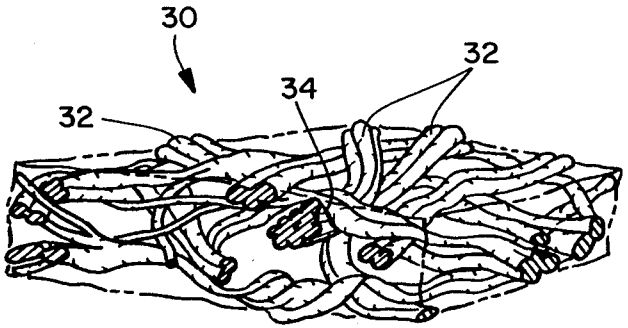
FIG. 12 is a partial section perspective illustration of a web useful in accordance with the present invention.

Turning to FIGS. 3–6, SEM photographs of cross-sections of filter plugs made from two webs (FIG. 3 and FIG. 4) useful in the practice of our invention, a conventional meltblown web (FIG. 5) and a spunbond web (FIG. 6) are also shown. FIGS. 7–10 are plan views of the same webs taken in the same order. The magnification used was the same for all photomicrographs and may be determined by measuring the long dashed line in the lower right corner of each photo which is the equivalent of 100 micrometers. Even on casual examination of these figures, the prevalence of large fiber agglomerates which were formed by the partial fusion of the molten fibers during web formation is particularly striking for webs of the invention shown in FIGS. 3 and 4 having a basis weight of 0.8 oz/yd$^2$ and 0.6 oz/yd$^2$, respectively. FIG. 12 schematically illustrates in perspective a similar view of webs useful in accordance with the present invention showing web 30, agglomerates 32 and bond crossover points 34.

Quantitative agglomerate distributions were obtained by counting cut ends of many photographs similar to FIGS. 3–6 and are presented in Table I below. Here the large fraction of total agglomerates for webs of FIGS. 3 and 4 clearly distinguish such webs from conventional meltblown webs and spunbond. In addition, shown as Example 0 are results obtained with a 0.6 oz/yd$^2$ web made as in FIG. 1 except that the number of agglomerates was reduced.

TABLE I

| | FIBER AGGLOMERATES DISTRIBUTIONS | | | | |
|---|---|---|---|---|---|
| Sample | % 1 Fiber | % 2–3 Fibers | % 4–6 Fibers | % 6 Fibers | % Total Agglomerates |
| FIG. 3 | 38% | 35.8% | 22.2% | 3.6% | 61.6% |
| FIG. 4 | 57.6% | 28.6% | 11.7% | 2.0% | 42.3% |
| Regular Meltblown Web (0.6 oz/yd$^2$) (FIG. 5) | 65.4% | 24% | 8.4% | 2.2% | 34.6% |
| Spunbond Web (FIG. 6) (1.0 oz/yd$^2$) | 100% | | | | |
| Example 0 | 66% | 25.7% | 7.3% | 1-0% | 34.0% |

It is our understanding that these fused agglomerates are responsible for imparting the high bending moduli to these webs which in turn provides the enhanced rigidity of filter plugs made from these webs. Without these agglomerates, filter plugs made from polyolefin tows or webs fail to yield practical filter plugs of adequate firmness. Additionally, the presence of these agglomerates clearly distinguish the webs made in accordance with this invention from meltblown webs of commerce. Indeed, in presently commercial meltblown webs the presence of the agglomerates is considered to be functionally and aesthetically undesirable.

While webs of the invention as shown in FIGS. 3 and 4 may be formed using conventional meltblowing apparatus of the type shown in FIG. 1, operating parameters will be adjusted to produce the desired agglomerates. Ordinarily such agglomerates are considered undesirable, and operating conditions are adjusted to minimize their formation. In accordance with this aspect of the present invention, however, the parameters such as air temperature and rate as well as forming distance are varied according to the polymer being extruded so as to produce the desired level of fiber agglomerates. For example, reducing the air flow and reducing forming distance will each tend to increase agglomeration.

While it is not desired to limit the invention to any particular theory, one possible explanation for the resulting desirable plug firmness and pressure drop may be understood by considering that the agglomerates behave as columns which strongly resist buckling during plug formation from the meltblown web. On this subject of columns and their mechanical behavior, reference may be made to the chapter "Mechanics of Material" by J.P. Vidosic, pp. 5–40 to 5–42 in "Marks Standard Handbook for Mechanical Engineers", 8th Ed., McGraw-Hill, New York, N.Y. (1958):

"COLUMNS

Members subjected to direct compression can be grouped into three classes. Compression blocks are so short (slenderness ratios below 30) that bending of member is not pending. At the other limit, columns so slender that bending is primary, are the long columns defined by Euler's theory. The intermediate columns, quite common in practice, are called short columns. Long columns and the more slender short columns usually fail by buckling when the critical load is reached. This is a matter of instability; that is, the column may continue to yield and deflect even though the load is not being increased above critical. The slenderness ratio is the unsupported length divided by the least radius of gyration, parallel to which it can bend.

Long columns are handled by Euler's column formula, $$P_{cr}=n\pi^2EI/L^2=n\pi^2EA/(L/R)^2$$

In these equations:

$P_{cr}$=critical load to cause buckling of the column n=a coefficient which accounts for column end conditions; when both ends are fixed, n=4

E=longitudinal modulus of elasticity

I=moment of inertia

A=cross-sectional area of the column

L=length of the column

R=least radius of gyration. For circular cross-section, R is equal to the diameter divided by 4; for rectangular cross-sections, R is equal to the length of the shortest side divided by the square root of 12.: (For our purposes, the shortest cross-section dimension divided by 4 will represent R.)

The dimensionless ratio (L/R) appearing in the above equation is known as the "slenderness ratio". To assure the column fails solely by buckling, this ratio should exceed 120 and preferably exceed 150, which will be met for the majority of the columns considered here. It is important to note in Euler's equation that the critical buckling load is related inversely with the square of the slenderness ratio, which implies that the magnitude of this load will be very sensitive to slight changes in column dimensions.

In fiber mechanics, the modulus E is usually reported in units of grams/denier. Therefore the area, A, in Euler's equation should be expressed in denier units so that the product EA has the dimension of grams of force. For the example of polypropylene used in accordance with the present invention, E≅10 g/denier. (This low modulus value may be contrasted with that for cellulose acetate tows used in conventional cigarette filters where E≅45 g/denier. This disparity in moduli may account for the lack of firmness in filters from polypropylene tows which have had little success as cigarette filter plugs.).

In Table II below, data are presented for the webs of FIGS. 3–10 and Table I which permit Euler equation solutions for the component fibers and fiber agglomerates. The large differences in denier and slenderness ratios for the webs of this invention (FIG. 3 and FIG. 4 examples) when compared to a conventional meltblown web are apparent. These differences in slenderness ratios give the large load enhancements shown in the last column of this Table.

Webs useful in accordance with the invention will include at least one third agglomerates and will have a slenderness ratio no greater than 1000 for single fibers and no greater than 500 for agglomerates.

TABLE II

EULER COLUMN CALCULATIONS FOR FIBER

| | Denier | R, μm | L, mm | Slenderness Ratio L/R | Buckling Load Enhancement Relative to Comparable Regular Meltblown structures |
|---|---|---|---|---|---|
| FIG. 3 Sample | | | | | |
| Single fiber | 6.6 | 8.0 | 1.5 | 190 | 320 |
| 2–3 fibers | 20 | 14 | 1.5 | 106 | 290 |
| 4–6 fibers | 42 | 20 | 1.5 | 75 | 140 |
| FIG. 4 Sample | | | | | |
| Single fiber | 1.3 | 3.6 | 2.0 | 500 | 46 |
| 2–3 fibers | 7.5 | 8.6 | 2.0 | 230 | 61 |

TABLE II-continued

EULER COLUMN CALCULATIONS FOR FIBER

| | Denier | R, μm | L, mm | Slenderness Ratio L/R | Buckling Load Enhancement Relative to Comparable Regular Meltblown structures |
|---|---|---|---|---|---|
| 4–6 fibers | 12 | 11 | 2.0 | 180 | 25 |
| Example 0 | | | | | |
| Single fiber | 0.49 | 2.0 | 2.2 | 1,000 | 12 |
| 2–3 fibers | 4.0 | 6.3 | 2.2 | 355 | 26 |
| 4–6 fibers | 2.8 | 5.0 | 2.2 | 420 | 5 |
| Conventional Meltblown Web | | | | | |
| Single fiber | 0.07 | 0.8 | 2.7 | 3400 | 1 |
| 2–3 fibers | 0.23 | 1.5 | 2.7 | 1800 | 1 |
| 4–6 fibers | 0.80 | 2.8 | 2.7 | 900 | 1 |
| Spunbond Web | | | | | |
| Single fiber | 5.7 | 7.5 | ∞ | ∞ | 0 |

Such enhancements suggest that webs of FIGS. 3 and 4 can be fabricated into filter plugs of adequate firmness without collapsing causing the high pressure drop structures characteristic of plugs made from conventional meltblown webs. Similarly, the infinite slenderness ratio for the spunbond web (zero buckling force) suggests that it should behave similarly to polypropylene tow when fabricated into filter plugs, i.e., unacceptably high pressure drop at adequate filter firmness. All of these factors are supported by the data in Table III.

TABLE III

| Sample | Filter Wt. mg/cm. | Pressure Drop cm/$H_{H2}O$/cm length | Firmness % |
|---|---|---|---|
| FIG. 3 | 78 | 0.8 | 97.4 |
| FIG. 4 | 74 | 2.5 | 96.8 |
| Example 0 | 73 | 2.9 | 96.7 |
| Conventional Meltblown Web | 71 | 23.2 | 96.2 |
| Spunbond Web | 132 | 20.7 | 98.2 |

In accordance with the present invention, the agglomerates will preferably have unsupported lengths in the range of 1–2 millimeters with deniers greater than or equal to 2, and equivalent diameters preferably in the range of 20 to 100 micrometers (2.5 denier to 65 denier for polypropylene). In addition, the number fraction of these agglomerates will preferably exceed 40 percent. For fabricating filter plugs with a desired high pressure drop, the denier of the agglomerates are preferably on the low side, while preparing filter plugs with a low pressure drop, larger diameters are preferred.

Example 0 with reduced agglomerates and a pressure drop of about 2.9 cm $H_2O$/cm length represents about the maximum pressure drop suitable for a filter plug.

EXAMPLES

Examples 1–4

The webs in Examples 1–4 were produced as illustrated using equipment similar to that shown in FIG. 1 and having a basis weight of 0.6 oz/yd$^2$ and 0.8 oz/yd$^2$, respectively. The thermoplastic polymer used in these examples was Exxon 3214 polypropylene. Physical data for these webs are given in Table IV while filter performance and delivery data for these plugs made from these webs are given in Tables V and VI, respectively. Also included in Table V is a cellulose acetate filter plug labeled "Control 1" which was removed from a Marlboro brand cigarette. Table VI also contains data labeled "Control 1" and "Control 2" which represent a Marlboro cigarette smoked with and without filters, respectively.

Examples 5–6

Examples 5 and 6 were produced using equipment as described with respect to FIG. 1. Example 5 was composed of 10 percent by weight calcium carbonate from Genstar Corporation and 90 percent by weight Himont PC-973 polypropylene. The calcium carbonate had been preblended into the polypropylene, extruded and pelletized before the mixture was meltblown into a web for our invention. Due to the structural differences between the fibers, filter plugs produced from calcium carbonate loaded fiber webs will tend to modify the filtration characteristics found in filter elements produced from unfilled webs.

Example 6 was composed of Valox 315 poly (butylene terephthalate) from General Electric Corporation. Web physical data and filter performance characteristics for Examples 5 and 6 are shown in Tables IV and V, respectively.

TABLE IV

| Example Number | Grab Tensile MD (lbs) | Grab Tensile CD (lbs) | Trap Tear MD (lbs) | Trap Tear CD (lbs) | Frazier Porosity 5 Ply (ft$^3$/ft$^2$/min) | Handle-O-Meter MD (gm) | Handle-O-Meter CD (gm) | Open Area (%) |
|---|---|---|---|---|---|---|---|---|
| 1 | 1.2 | 1.4 | 0.3 | 0.3 | 218 | 9.2 | 10.5 | 14.6 |
| 2 | 1.0 | 1.2 | 0.4 | 0.3 | 689 | 25.4 | 14.2 | 50.8 |
| 3 | 1.2 | 1.3 | 0.6 | 0.7 | 376 | 3.0 | 3.4 | 31.5 |
| 4 | 2.1 | 1.6 | 1.4 | 0.7 | 603 | 21.9 | 9.0 | 43.1 |

TABLE V

| Example Number | Filter Wgt. (mg/cm of filter length) | Filter Pressure Drop (cm $H_2O$/cm of length) | Firmness (%) |
|---|---|---|---|
| 1 | 85 | 4.6 | 98.1 |
| 2 | 62 | 0.5 | 97.4 |
| 3 | 74 | 2.5 | 96.8 |
| 4 | 78 | 0.8 | 97.4 |
| 5 | 73 | 1.4 | 98.1 |
| 6 | 96 | 1.2 | 98.1 |
| Control 1 | 62 | 2.4 | 96.5 |

TABLE VI

| Example Number | Filter Pressure Drop (cm $H_2O$/21 mm filter) | Delivery (mg./cig.) Tar | Nicotine | $H_2O$ | Delivery (mg/puff) Tar | Nicotine | $H_2O$ |
|---|---|---|---|---|---|---|---|
| 1 | 10.8 | 12.6 | 0.67 | 1.1 | 1.4 | 0.07 | 0.12 |
| 2 | 1.0 | 35.2 | 1.58 | 7.4 | 3.7 | 0.17 | 0.81 |
| 3 | 5.4 | 23.3 | 0.96 | 3.9 | 2.6 | 0.11 | 0.44 |
| 4 | 2.0 | 34.4 | 1.51 | 7.8 | 3.7 | 0.16 | 0.83 |
| Control 1 | 7.1 | 22.7 | 1.12 | 4.2 | 2.4 | 0.12 | 0.45 |
| Control 2 | — | 38.5 | 1.63 | 9.6 | 4.2 | 0.18 | 1.05 |

From a review of the data of Tables IV, V and VI it can be seen that the filter plugs made with the webs in accordance with the present invention provide selective filter properties including pressure drop and delivery which embrace those obtained with conventional cellulose acetate filters. In addition, it can be seen that pressure drop can be varied over a wide range while maintaining firmness at levels exceeding those possible for cellulose acetate filters. Therefore, the present invention provides a thermoplastic fiber filter having the desired filtration property with the tactile properties of firmness and lack of collapse that meet or exceed those of conventional filters.

FIG. 11 is a graph which shows how the filter firmness changes with the amount of tobacco rod consumed in this continuous smoking mode. In this Figure, the behavior of filter plugs made from the preferred polypropylene webs made in accordance with the present invention along with the behavior of conventional cellulose acetate tow filter plugs are shown. As seen from this Figure, filter plugs made from the webs of the present invention do not suffer from the excessive collapse exhibited by conventional cellulose acetate filter plugs.

This resistance to collapse by filter plugs made from webs according to the present invention has important consequences during the smoking of a filter cigarette. First, and most obvious, is that such filter plugs are free from the "mushiness" which is perceived as a negative attribute by most smokers. Second, and more important, is the fact that severe collapse of a filter plug during smoking can lead to the formation of channels along the periphery of the filter element. These channels allow the smoke to bypass the filter element thus vitiating the desired filtration efficiency of the cigarette filter.

Thus, it is apparent that there has been provided, in accordance with the invention, an improved filter material for smoking articles that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the claims.

We claim:

1. Nonwoven web having a slenderness ratio value no greater than 500 for agglomerates comprising thermoplastic fibers or filaments that are present as fused agglomerates in a number fraction exceeding 33 percent and wherein a majority of fiber crossings of agglomerates are weld points.

2. Nonwoven web of claim 1 wherein said thermoplastic is selected from the group consisting of polyolefins and polyesters.

3. Nonwoven web of claim 2 wherein said thermoplastic is polypropylene and said agglomerates have a denier in the range of from about 2.5 to 65.

4. Nonwoven web of claim 2 wherein said web contains one or more additives distributed throughout said web.

5. Nonwoven web of claims 1, 2, 3, or 4 having a basis weight in the range of from about 0.5 oz/yd$^2$ to 1.0 oz/yd$^2$, machine direction grab tensile to cross machine direction grab tensile ration in the range of from about 1:1 to 4:1, and Handle-O-Meter stiffness less than 40 g in both machine and cross-machine directions.

6. Nonwoven web of claim 5 having a Frazier porosity in the range of from about 150 to 1000 (five ply) and slenderness ratio value less than 1000 for single fibers.

7. Nonwoven web of claim 5 wherein said fibers of filaments are meltblown.

8. Filter plug for a smoking article, said plug comprising a cylinder adapted to fit the smoking article and formed from a nonwoven web of thermoplastic fibers or filaments wherein said fibers or filaments are present as agglomerates in a number fraction exceeding 40 percent and a majority of fiber crossings of agglomerates are weld points and said web has a basis weight in the range of from about 0.5 oz/yd$^2$ to 1.0 oz/yd$^2$, machine direction to cross machine direction grab tensile ratio in the range of from about 1:1 to 4:1, and slenderness ratio for a majority of agglomerates no greater than 500.

9. Filter plug of claim 7 having a firmness value in the range of about 94 to 99 percent and a pressure drop in the range of from about 0.1 to 6.0 cm water per cm filter plug length.

10. Filter plug of claims 8 or 9 wherein said thermoplastic is selected from the group consisting of polyolefins and polyesters.

11. Filter plug of claim 10 wherein said thermoplastic is polypropylene.

12. Filter plug of claim 10 wherein said web contains one or more additives distributed throughout said web.

13. Smoking article comprising a smoking column and a filter plug contained within a wrapper, the improvement wherein said filter plug comprises a cylinder adapted to fit the smoking article and formed from a nonwoven web of thermoplastic fibers or filaments wherein said fibers or filaments are present as agglomerates in a number fraction exceeding 33 percent and said web has a basis weight in the range of from about 0.5 $oz/yd^2$ to 1.0 $oz/yd^2$, machine direction to cross machine direction grab tensile ratio in the range of from about 1:1 to 4:1, and slenderness ratio for a majority of agglomerates in excess of about 120 and no greater than about 500.

14. Smoking article of claim 13 wherein said fiber plug has a firmness value in the range of about 94 to 99 percent and a pressure drop in the range of from about 0.1 to 6.0 cm water per cm filter plug lengths.

15. Smoking article of claims 13 or 14 wherein said thermoplastic is selected from the group consisting of polyolefins and polyesters.

16. Smoking article of claim 15 wherein said thermoplastic is polypropylene and said agglomerates have a denier in the range of from about 2.5 to 65.

17. Smoking article of claim 15 wherein said web contains one or more additives distributed throughout said web.

* * * * *

UNITED STATES PATENT AND TRADEMARK OFFICE

CERTIFICATE OF CORRECTION

PATENT NO. : 4,961,415

DATED : October 9, 1990

INVENTOR(S) : F. R. Radwanski, D. F. Durocher, L.E. Chambers, Jr., L. G. Kasbo, W. F. Cartwright, R. G. Geer and E. P. Bullwinkel

It is certified that error appears in the above-identified patent and that said Letters Patent is hereby corrected as shown below:

Column 2, line 2, before the sentence beginning "This filter web..." please insert the following: --Webs useful in accordance with the invention will include at least one third agglomerates and will have a slenderness ratio no greater than 500 for agglomerates.--;

Column 2, line 51, "in the about" should read --from about--;

Column 2, line 52, "from cross" should read --in the cross--;

Column 2, line 66, "2 5/8" should read --2 3/8--;

Column 7, line 16, "parameters such" should read --parameters, such--;

Column 7, line 17, "distance are" should read --distance, are--;

Column 8, line 16, "12.:" should read --12".--;

Column 9, line 34, "cm/$H_{H2}$O/cm" should read --cm $H_2O$/cm--;

Column 12, line 34 (Claim 5), "ration" should read --ratio--;

Column 12, line 40, "the 2nd of" should read --or--;
should read --or--;

UNITED STATES PATENT AND TRADEMARK OFFICE

CERTIFICATE OF CORRECTION

PATENT NO. : 4,961,415

DATED : October 9, 1990

INVENTOR(S) : F. R. Radwanski, D. F. Durocher, L. E. Chambers, Jr., L. G. Kasbo, W. F. Cartwright, R. G. Geer and E. P. Bullwinkel

It is certified that error appears in the above-identified patent and that said Letters Patent is hereby corrected as shown below:

Column 13, line 11 (Claim 14), "fiber" should read --filter--.

Signed and Sealed this

Sixth Day of July, 1993

*Attest:*

Michael K. Kirk

MICHAEL K. KIRK

*Attesting Officer*

*Acting Commissioner of Patents and Trademarks*